United States Patent [19]

Thomas

[11] 4,157,600

[45] Jun. 12, 1979

[54] HINGE ASSEMBLY

[75] Inventor: Michael D. Thomas, Arab, Ala.

[73] Assignee: Ryder International Corporation, Barrington, Ill.

[21] Appl. No.: 902,290

[22] Filed: May 1, 1978

[51] Int. Cl.[2] ..... E05D 5/12; E05D 11/06

[52] U.S. Cl. ..... 16/169; 16/191

[58] Field of Search ..... 16/137, 171, 173, 174, 16/175, 139, 140, 141, 142, 143, 144, 149, 169, 178, 191

[56] References Cited

U.S. PATENT DOCUMENTS

| | | | |
|---|---|---|---|
| 2,347,981 | 5/1944 | Apfelbaum | 16/175 |
| 2,429,447 | 10/1947 | Apfelbaum | 16/171 |
| 2,527,318 | 10/1950 | Magnus | 16/171 X |
| 2,546,590 | 3/1941 | Ferrel | 16/171 X |
| 2,746,081 | 5/1956 | Gershen | 46/174 X |
| 2,874,401 | 2/1959 | Kotkins | 16/169 X |
| 3,455,059 | 7/1969 | Evans | 16/174 X |
| 3,577,840 | 5/1971 | Buberniak | 16/142 |
| 3,806,987 | 4/1974 | Koziol | 16/191 |

*Primary Examiner*—George H. Krizmanich

*Attorney, Agent, or Firm*—Trexler, Wolters, Bushnell & Fosse, Ltd.

[57] ABSTRACT

A hinge assembly for pivotally joining a cover or lid member with a base or housing member, or the like. The cover member includes a pair of coaxial and inwardly facing rod-like pivot members which are axially spaced apart and project from the lid or cover member. The base or container member includes a receptacle arrangement, including an elongate locking slot and a pair of arcuate grooves formed at either end, the grooves generally defining segments of a tubular hinge knuckle for receiving the rod-like pivot members. A locking member is employed to maintain the cover in articulate assembly, said locking member comprises a base or frame segment slidably insertable in the elongate locking slot, and having a pair of fingers extending outwardly of opposite sides of the base or frame segment, each said finger having arcuate inner surface portions defining generally segments of a tubular hinge knuckle. Further said base or frame segment includes a locking tab portion for snap-like engagement in the locking slot when the base portion is assembled. The respective knuckle segments on the locking member and the base member upon assembly surrounding the rod-like members on the cover, thereby to maintain said cover in pivotal assembly with the base member.

9 Claims, 5 Drawing Figures

10
14
3
3
16
20
18
12

36
38
38a
42
40a
40
34
14
38
22
46
49
48
54
58
50
26
24
16
30
44
32
60
28
20
12
12

46
48
48a
5.
46a
50
52
22
56
52
51
54
53
44
5.

49
46b
48
56a
22
56
54
56a
52
44

14
46a
46
36
28
26
38
58
56b
56
56a
12
52
54
22

HINGE ASSEMBLY

BACKGROUND OF THE INVENTION

This invention relates generally to hinges and more particularly to a hinge assembly for pivotally joining two members, such as a base or housing and a cover or lid member.

While the present invention may find a wide range of applications, the description will be facilitated by reference to the problem of pivotally joining a cover or lid member to a base or housing assembly of a contact lens sterilizing apparatus. With this type of apparatus, the base or housing generally contains a heating unit and includes an aperture into which a lens case is inserted and placed in contact with the heating unit, to elevate the temperature of a sterilizing solution within the case, to destroy any bacteria that may be present on the lenses. In such apparatus, it is desirable to provide a hinged cover or lid member which overlies the capsule and the heating unit aperture to prevent inadvertent contact while the unit is at an elevated temperature.

While there are numerous ways to provide for such a pivotal mounting of a lid or cover, the design of the present invention to be discussed more fully hereinafter provides a simple yet reliable hinge structure which is relatively inexpensive to fabricate and most importantly, can be assembled with a minimum amount of effort and skill. Briefly, a hinge structure according to the invention comprises pintle means on one member to be hingedly joined, a locking slot means and knuckle defining segment on the opposite member to be hingedly joined, and a locking member comprising means providing a knuckle segment complementary with the first mentioned knuckle segment, and locking tab means engageable in said locking slot means for aligning said knuckle segments to provide a tubular knuckle which surrounds the pintle means to provide the pivotal mounting of the lid to the base member.

Other objects, features, and advantages of this invention will be appreciated upon consideration of the following detailed description and the accompanying drawings wherein like reference numerals designate like elements and components.

DESCRIPTION OF THE ILLUSTRATED EMBODIMENT

Figure 1:
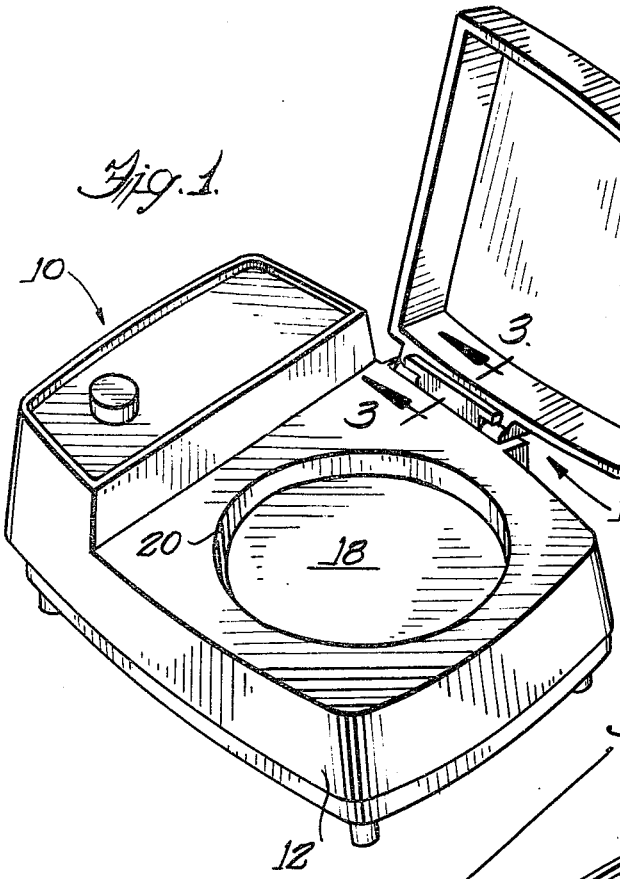
FIG. 1 is a perspective view of an assembled contact lens sterilizing unit in which the hinge structure of this invention is embodied.

The description of the hinge assembly of this invention is facilitated herein by reference to the specific embodiment illustrated in the drawings. It is not desired, however, to limit the invention to use with a sterilizer unit, as it may be employed with a wide variety of designs. On the contrary, it is intended that said invention shall include such alternative embodiments as may occur to those skilled in the art, the invention being more properly defined by the claims appended hereto.

As mentioned above, the hinge assembly of this invention is embodied in a lens sterilizing unit for purposes of illustration and description. Accordingly, referring now to the drawings in detail, and initially to FIG. 1, a lens sterilizing unit, designated generally 10, is shown which comprises a base or housing member 12 and a lid or cover member 14. A hinge assembly, designated generally 16, in accordance with this invention is utilized to effect a hinged mounting of the lid or cover member 14 to the base or housing member 12. The structural details and features of the lens sterilizing apparatus 10, aside from those features forming a part of the hinge assembly 16, form no part of this invention and will not be described in detail. Suffice it to say that the base or housing 12 includes a metallic heating block 18, a portion of which is exposed due to the formation of an aperture 20 in an upper surface of the housing 12. Suitable electrical circuits (not shown) including a resistance heating element associated with block 18 are included inside the housing 12 for selectively energizing the heating block 18. The receptacle 20 provides means whereby a lens case (not shown) containing a sterilizing solution and a pair of lenses may be mounted in engagement with the heating block 18. As such, the temperature of the solution can be elevated to destroy any bacteria on the lenses.

The cover or lid 14 is adapted to cooperate with the housing 12 via the action of the hinge assembly 16 to provide a selectively openable closure for the receptacle 20 and a lens case disposed therein. Thus, the lid or cover 14 may be opened to dispose a lens case within the receptacle 20 and closed while the sterilizing process is being carried out.

Figure 2:
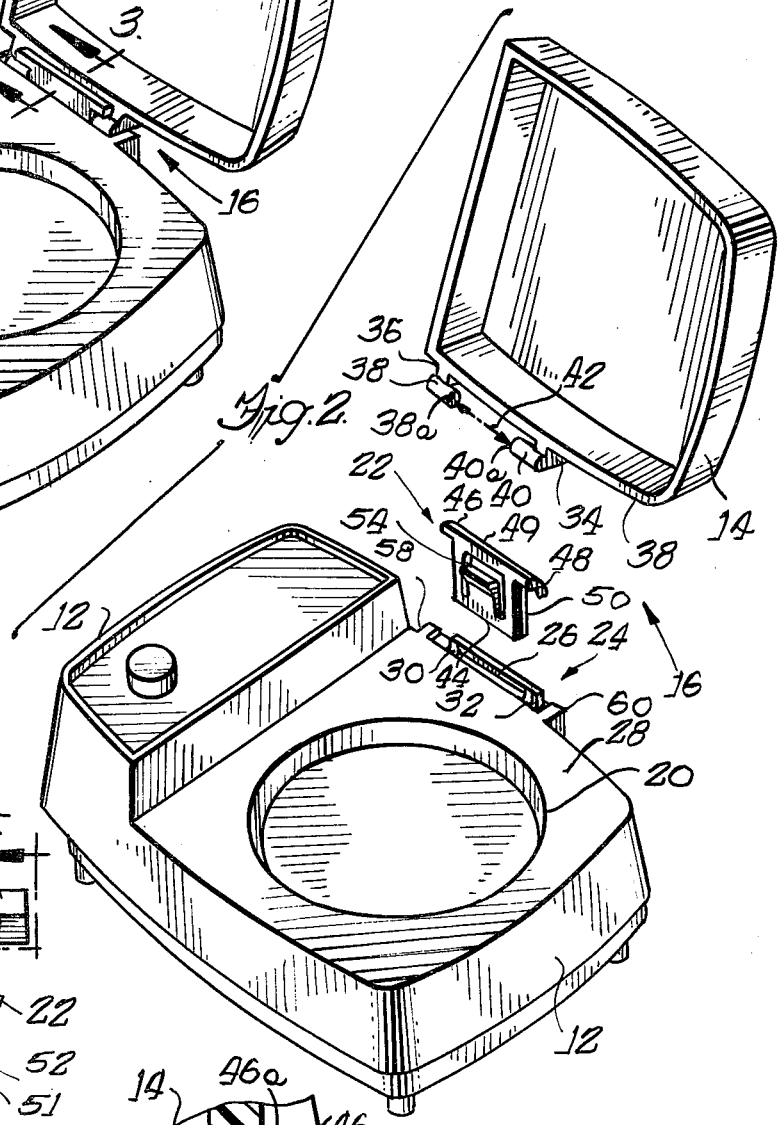
FIG. 2 is an exploded perspective view of FIG. 1 revealing additional details of the hinge structure of this invention.

Referring now also to FIG. 2, the hinge assembly 16 is seen to comprise cooperating portions formed on the respective housing 12 and cover or lid 14, as well as a locking member designated generally 22 for joining these cooperating portions. In general, the base member or housing 12 includes a receptacle portion designated generally 24 which includes an elongate slot 26 formed in a top surface or wall 28 of the housing 12, and extending through said wall 28. On either side of the elongate slot 26 and generally symmetrically thereabout, there are provided a pair of grooves or indentations 30, 32 formed in the surface of wall 28. The grooves or indentations 30 or 32, in the illustrated embodiment, are generally arcuate and present surfaces generally defining a segment of a cylinder. The lid or cover member 14 includes a pair of generally parallel, spaced apart flange portions 34, 36 on a side wall surface 38 thereof. At the distal edges of the flanges 34 and 36, a pair of generally cylindrical rod-like members 38 and 40 are formed, which, as will be seen later, generally function as hinge pins or pintle members. The rod-like members 38 and 40 are generally coaxial and project from the ribs 34 and 36 to extend axially inwardly and include facing surfaces **38*a* and 40*a* which are spaced apart by a dimension indicated generally by the reference numeral 42**.

Figure 4:
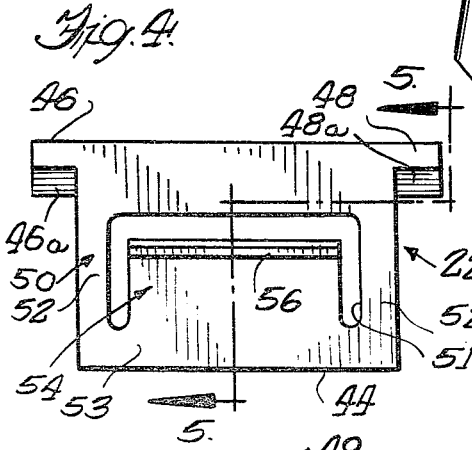
FIG. 4 is an enlarged elevational view of a locking member of the hinge assembly of this invention.
Figure 5:
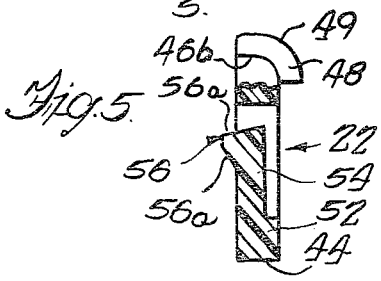
FIG. 5 is a view taken generally along the line 5—5 of FIG. 4.

The locking member 22 which is formed of a resilient plastic material comprises a generally flat rectangular frame element best illustrated in FIGS. 4 and 5, including a leading edge 44 of generally similar dimensions to the slot 26. Opposite the leading edge 44, the locking member 22 has a pair of generally symmetrically disposed and laterally outwardly extending arms or fingers 46, 48 formed thereon. These outwardly extending arms 46 and 48 present generally curved inner and outer surfaces, said inner surfaces 46*a* and 48*a* being arcuate and generally complementary to the surfaces 30 and 32, while the outer curved surface 49 extends across the entire width of the member 22 between the hinges 46 and 48. As shown in FIG. 4 the locking member 22 includes a central frame portion 50 defined by a pair of spaced arm segments 52, a base segment 53, with a central locking tab portion 54 projecting from said base section. The locking tab portion 54 is surrounded by an aperture 51, such that said locking tab portion 54 is slightly resilient and can flex with respect to the arm and base segments 52 and 56. Adjacent the free edge of tab 54 there is provided a lateral flange or ridge designated generally 56, which extends outwardly of the front surface of the frame 52. It will be seen that the ridge or flange 56 has a gradually sloping leading edge 56*a* and a more abrupt trailing edge 56*b*, for a purpose to be explained more fully hereinafter.

Figure 3:
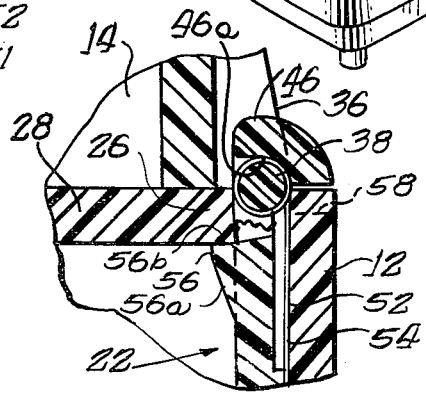
FIG. 3 is an enlarged sectional view taken generally along the line 3—3 of FIG. 1.

Referring now to FIG. 3 in conjunction with FIG. 2, the manner in which the foregoing parts cooperate to form the assembled hinge structure will be discussed. Initially, the lid 14 is placed upon the base or housing 12 so as to position the rod-like pin or pintle members 38 and 40 within the respective arcuate grooves or channels 30 and 32. Thereafter, the locking member 22 is inserted by its leading edge or surface 44 into the slot 26 with the ledge or detent 56 facing the base 12. It will be recalled that the locking member 22 is formed of a resilient material and that the tab 54 is flexible. Accordingly, as the frame section 50 passes into the slot 26, the leading, tapered surface 56*a* of detent 56 will engage the edge of top surface 28 defining slot 26. This engagement will tend to cam or force the tab back away from its normal position, allowing said detent 56 to pass inwardly of said slot. Upon clearing the wall 28 of the housing 12, the resilient tab 54 returns to its normal protruding position, FIG. 3, with the abrupt surface 56*b* thereof disposed beneath the under surface of the top wall 28, to preclude or resist removal of the locking member 22 from the slot 26.

When the locking tab 54 snaps in place the arm portions 46 and 48 of the locking member 22 will be in cooperating position with respect to the grooves or channels 30 and 32. As such the respective arcuate surfaces 46*a* and 30 and 48*a* and 32 cooperate to define a pair of tubular hinge knuckles which surround and captively engage the respective rod-like pin members 38 and 40, thus enabling the lid 14 to pivot, within certain limits, with respect to the base 12.

Referring again to FIGS. 1 and 2, it will be seen that the hinge arrangement 16 is designed to provide a stop, for the lid 14 when in the fully opened position with respect to the housing or base 12. More specifically, the grooves or channels 30 and 32 communicate laterally and outwardly with a pair of relatively flat channels or grooves 58 and 60 extending generally perpendicular to the axes of the curved surfaces 30 and 32. These grooves or channels 58 and 60 are of generally similar width and are spaced apart by a similar dimension as the ribs 34 and 36 on the lid 14. Accordingly, at a predetermined point of the hinged movement of the lid 14 with respect to the base or housing 12, the ribs 34 and 36 will be received in the channels 58 and 60 and will engage the bottom wall surface thereof to preclude further movement and thus define the fully opened position for said lid 14.

Accordingly, from the foregoing, it is believed clear that there is provided a relatively simple and inexpensive hinge structure, the parts of which may be molded or otherwise formed from plastic material. Moreover, it will be seen that the assembly of the foregoing parts is simple, and can be accomplished by relatively unskilled workers, without deterring from the reliability of the overall construction.

While the present invention has been described with respect to a specific embodiment illustrated, it is not intended to limit the invention thereto. On the contrary, various changes, modifications and alternatives, as for example in the form, arrangement or proportions of parts, may suggest themselves to those skilled in the art and possessed of this disclosure. The present invention, therefore, is intended to include all of such changes, modifications or alternatives as fall within the spirit and scope of the claims appended hereto.

The invention is claimed as follows:

1. A hinge assembly for pivotally joining a cover member or the like to a base member, said hinge assembly comprising: pintle means on said cover member, a locking member including a first portion defining a segment of a hinge knuckle and a second portion defining locking tab means, receptacle means in said base member including a first portion defining a segment of a hinge knuckle and a second portion defining locking slot means, said locking tab means being engageable with said locking slot means for holding said first portion of said locking member in alignment with said first portion of said base member to define a hinge knuckle surroundingly and pivotally engaging said pintle means of said cover member.

2. A hinge assembly according to claim 1 wherein said pintle means comprises a pair of generally cylindrical rod-like members, and means on said cover member for holding said rod-like members generally along a common axis substantially parallel with a side surface of said cover member, and extending axially inwardly to define axially spaced apart facing edges.

3. A hinge assembly according to claim 2 wherein said locking member comprises a generally flat, frame-like member of substantially like width with said axial space between said facing edges, said first portion of said locking member comprising a pair of fingers extending oppositely laterally outwardly of said frame-like member and having curved inner surface portions for engaging at least a portion of the external side surfaces of said rod-like members.

4. A hinge assembly according to claim 3 wherein said second portion of said receptacle means comprises an elongate slot extending through a top wall of said base member and of length substantially similar to said width of said flat frame-like member, and said first portion of said base member comprises a pair of grooves extending laterally outwardly of opposite ends of said elongate slot and curving inwardly of said top wall for engaging at least a portion of the external side surfaces of said rod-like members.

5. A hinge assembly according to claim 4 wherein said locking tab portion of said locking member comprises a resilient member extending laterally outwardly of said frame-like member and resiliently yieldable for insertion through said slot for snappingly engaging an inner surface of said top wall.

6. A hinge assembly according to claim 5 wherein said means on said cover member for holding said rod-like members includes a pair of upstanding, elongate ribs generally perpendicular with said rod-like members and confluent with said rod-like members at said portions thereof remote from said facing surfaces, and said receptacle means further includes top means for engaging said rib members to define a fully opened position of said cover member with respect to said base member.

7. A hinge assembly for pivotally joining a cover member or the like to a base member, said hinge assembly comprising; pintle means formed on said cover, receptacle means formed in said base member including means defining a segment of a hinge knuckle for receiving said pintle means, and a slot, and locking member for maintaining said pintle means in assembly with said receptacle means of said base member, said locking member including, a segment insertable in said slot provided by said receptacle means, said segment including detents means for resisting removal of said locking member once assembled to said base member, and means defining a segment of a hinge knuckle complementary to that provided by said receptacle means, such that upon assembly the respective hinge knuckle segments surround said pintle means to provide for the pivotal mounting thereof.

8. A hinge assembly as defined in claim 7 wherein said locking member segment includes a resilient tub portion having a detent formed thereon, and said slot includes a ledge portion, under which said detent is engaged upon assembly to resist removal of said locking member.

9. A hinge assembly according to claim 7 wherein said pintle means includes a pair of spaced rod-like segments projecting from said cover member toward each other, and said receptacle means first portion includes a pair of spaced arcuate grooves, with said slot interposed therebetween, and said means on said locking member defining a segment of a hinge knuckle includes a pair of arcuate grooves complementary to those of said receptacle means, disposed on opposite sides of said segment insertable in said slot.

* * * * *